US010681438B2

(12) United States Patent
Bech

(10) Patent No.: US 10,681,438 B2
(45) Date of Patent: Jun. 9, 2020

(54) LOUDSPEAKER GRILLES

(71) Applicant: Harman Becker Automotive Systems GmbH, Karlsbad (DE)

(72) Inventor: Torsten Bech, Vildbjerg (DK)

(73) Assignee: Harman Becker Automotive Systems GmbH, Karlsbad (DE)

( * ) Notice: Subject to any disclaimer, the term of this patent is extended or adjusted under 35 U.S.C. 154(b) by 0 days.

(21) Appl. No.: 16/238,270

(22) Filed: Jan. 2, 2019

(65) Prior Publication Data

US 2019/0208297 A1 Jul. 4, 2019

(30) Foreign Application Priority Data

Jan. 4, 2018 (EP) ..... 18150349

(51) Int. Cl.

| | |
|---|---|
| ***H04R 1/00*** | (2006.01) |
| ***H04R 1/02*** | (2006.01) |
| ***H04R 31/00*** | (2006.01) |
| ***H04R 1/28*** | (2006.01) |

(52) U.S. Cl.

CPC ..... *H04R 1/023* (2013.01); *H04R 1/2803* (2013.01); *H04R 31/006* (2013.01); *H04R 2201/02* (2013.01); *H04R 2499/13* (2013.01)

(58) Field of Classification Search

CPC ..... H04R 1/023

See application file for complete search history.

(56) References Cited

U.S. PATENT DOCUMENTS

| | | | | |
|---|---|---|---|---|
| 1,884,724 | A | 10/1932 | Keller | |
| 4,817,163 | A | 3/1989 | Stastny | |
| 2017/0155989 | A1* | 6/2017 | Jeon | H04R 1/026 |

FOREIGN PATENT DOCUMENTS

| | | | |
|---|---|---|---|
| DE | 102016005453 | A1 | 2/2017 |

* cited by examiner

*Primary Examiner* — Matthew A Eason

(74) *Attorney, Agent, or Firm* — Brooks Kushman P.C.

(57) ABSTRACT

A dynamic arrangement for loudspeaker grilles is disclosed. A first perforated grille is operable to move with respect to a second perforated grille. The relative movement is controlled to cause the two respective sets of perforations to fall in or out of alignment as required, leading to advantageous effects such as different levels of acoustic transparency.

11 Claims, 6 Drawing Sheets

LOUDSPEAKER GRILLES

CROSS-REFERENCE TO RELATED APPLICATIONS

This application claims foreign priority benefits under 35 U.S.C. § 119(a)-(d) to EP Application Serial No. 18150349.1 filed Jan. 4, 2018, the disclosure of which is hereby incorporated in its entirety by reference herein.

TECHNICAL FIELD

The present invention generally relates to a dynamic arrangement of loudspeaker grilles.

BACKGROUND

A common loudspeaker may include a voice coil attached to a diaphragm. The voice coil may be positioned in a voice coil gap of the common loudspeaker, and the voice coil gap may be defined by a magnet assembly and a frame of the common loudspeaker. The common loudspeaker may receive an electrical acoustic signal, which may cause the voice coil to move in the voice coil gap. This movement may result from the interaction of the electrical acoustic signal, the voice coil, and the magnet assembly.

A conventional grille may be attached to the common loudspeaker. The conventional grille may include fixed openings for sound from the common loudspeaker to travel through. The fixed openings may be static, as such, the fixed openings may be permanently located at specific locations on the conventional grille. The fixed openings may be arranged in a permanent pattern. Moreover, once affixed to the common loudspeaker, the conventional grille may be a static component. The conventional grille may be a single, integral component, which may be entirely formed from a single material, such as a hard plastic or metal.

SUMMARY

It is herein disclosed a dynamic component for a loudspeaker, comprising at least two grilles.

According to an embodiment, there is provided a component for a loudspeaker, comprising a first grille including a first arrangement of perforations, and a second grille including a second arrangement of perforations. The second grille is operable to move or rotate relative to the first grille from a first position to a second position. The first arrangement of perforations and the second arrangement of perforations are aligned differently in the first position and the second position.

In one aspect, the first arrangement of perforations is the same as the second arrangement of perforations.

In another aspect, the first grille is disposed on a first plane and the second grille is disposed on a second plane parallel to the first plane. The first plane and the second plane are separated by a small gap close to zero in size, such as under 5 millimetres.

In one aspect, the first grille and the second grille are circular, and the second grille is operable to rotate about its centre.

In another aspect, the first grille is fixed.

In one aspect, the second grille is operable to move or rotate between the first position, at which perforations in the second grille and perforations in the first grille completely align, and the second position, at which perforations in the second grille and perforations in the first grille do not completely align.

In another aspect, the relative rotation between the second grille and the first grille creates a dynamic Moiré effect.

In one aspect, a front-facing face of the second grille has a distinct appearance from the front-facing face of the first grille.

In another aspect, the first grille is an outer grille of a loudspeaker and the second grille is an inner grille.

According to an embodiment, there is provided a loudspeaker comprising the component as described, and a motor operable to move or rotate the second grille.

In one aspect, the second grille rotates from the first position to the second position when the loudspeaker receives a first signal such as a turn-on signal, and the second grille rotates from the second position to the first position when the loudspeaker receives a second signal such as a turn-off signal.

In one aspect, the loudspeaker is integrated into an automotive vehicle.

In accordance with an embodiment, there is provided a loudspeaker comprising a first perforated grille, a second perforated grille which is partially obscured by the first perforated grille, and one or more motors to cause one or both of the perforated grilles to move or rotate relative to the other, causing a dynamic superposition of perforations in the grilles to demonstrate a Moiré effect.

In accordance with an embodiment, a method of operating a loudspeaker is provided, comprising receiving a signal, and moving (such as rotating) a first perforated grille of the loudspeaker relative to a second perforated grille, from a first position where perforations in the first grille and perforations in the second grille have a first alignment, to a second position where the perforations in the first grille and the perforations in the second grille have a second alignment different from the first alignment.

In one aspect, in the second alignment, the perforations in the first grille and the perforations in the second grille align, and in the first alignment, the perforations in the first grille and the perforations in the second grille fall out of alignment.

In order that the present invention be more readily understood, various aspects of specific non-limiting embodiments will now be described in conjunction with the attached drawings.

It is noted that the terms "moving" and "movement" encompass angular movement (such as rotation and tilting), and the term "position" encompasses angular position (such as orientation).

DETAILED DESCRIPTION

It is herein disclosed a dynamic arrangement of loudspeaker grilles.

The arrangement comprises a first grille and a second grille, at least one of which is adapted to move relative to the other, from a first position or orientation, to a second position or orientation in which the alignment of the perforations on the first grille and the perforations on the second grille is different compared to the first position or orientation. For example, in the second position, the perforations on the first grille and those on the second grille are aligned, whereas in the first position and other positions, the perforations are not fully aligned. The relative movement between the two grilles can be controlled to cause them to fall into varying levels of alignment, with advantageous effects on the acoustical transparency of the sound passing through the grilles and other aspects both technical and otherwise.

An embodiment of the arrangement will now be described with reference to the drawings.

Figure 1:
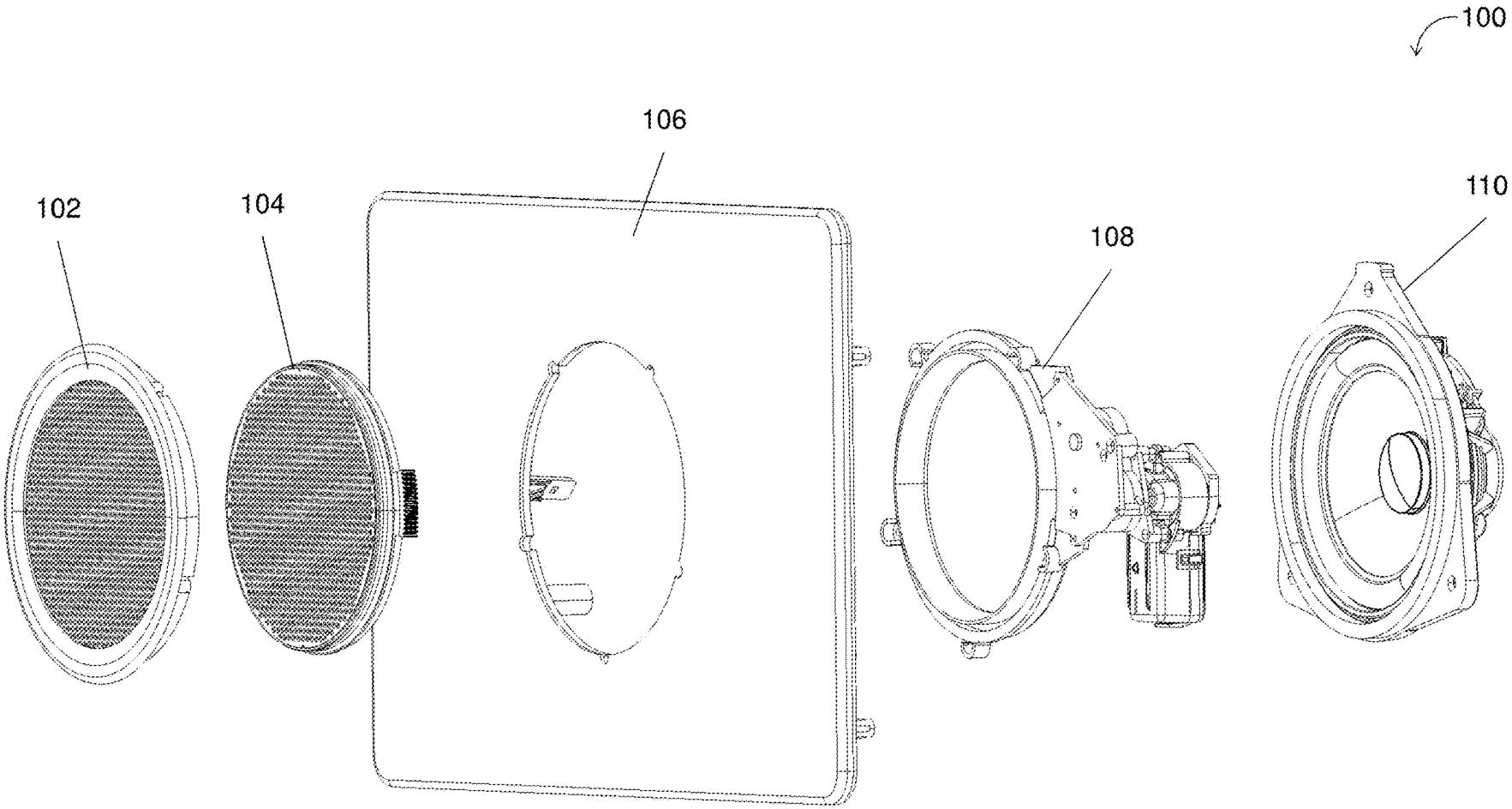
FIG. 1 shows an exploded view of components in an exemplary loudspeaker system in accordance with one or more embodiments.

FIG. 1 shows an exploded view of a number of components in an exemplary loudspeaker apparatus or system. The loudspeaker 100 comprises a first grille 102, a second grille 104, a door panel 106, a motor 108 and a transducer 110. For example, the door panel 106 forms a front face of an outer casing or container (not shown), in which the motor 108 and the transducer 110 are housed. The first, or outer, grille 102 is disposed on the front face of the door panel, and the second, or inner, grille 104 is disposed behind the first grille 102. The door panel has an opening of a shape and size that correspond to the first and second grilles allowing them to be connected to the motor 108, which causes the relative movement of the first grille 102 and the second grille 104.

In an aspect, the first grille 102 and the second grille 104 are both circular and are of the same size or substantially the same size. The first grille 102 may comprise an additional outer ring for protection. In another aspect, the first grille 102 and the second grille 104 are both planar or substantially planar, and they are disposed on adjacent parallel planes. In a further aspect, the first grille 102 and the second grille 104 are disposed close to one another, that is, the gap or separation between their respective planes is small; for example, the size of the gap may be under 5 millimetres, or may be on the order of lateral dimension of each individual perforation, or may be close to zero so that the inward-facing side of the first grille 102 and the outward-facing side of the second grille 104 effectively touch each other, but without affecting the smoothness of the relative motion between the first grille 102 and the second grille 104.

In one aspect, the first grille 102 is static and not moveable or rotatable, and is fixed to the door panel 106. The second grille 104, on the other hand, can be rotated by the motor 108, which may be a small electrical motor.

In an aspect, the second grille 104 is rotatable about an axis that is perpendicular to the parallel planes of the two grilles, and that passes through the respective centres of the two circular grilles. As the relative rotation between the first grille 102 and the second grille 104 occurs, a gradual change occurs to the appearance of the front face of the loudspeaker 100 as viewed by a user. This is due to the gradual changes in alignment between the perforations in the first grille 102 and those in the second grille 104.

In one aspect, the geometric arrangement of perforations (or the hole pattern) in the first grille 102 is the same as that in the second grille 104. For example, the arrangement of perforations in each grille is a regular hexagonally packed arrangement of a large number of small circular holes. In a particular hole pattern, there are approximately 960 identical circular holes arranged in an overall dodecagon shape covering most of the area of the circular grille (corresponding substantially to the view shown in FIG. 2*f*). The consequence of the two hole arrangements being the same in the two rotatable grilles 102, 104 is that there exists a relative position or orientation where each of the perforations on the first grille 102 aligns, perfectly or substantially, with a corresponding perforation on the second grille 104, corresponding to the illustration in FIG. 2*f*.

FIGS. 2*a* to 2*f* are a series of six drawings that illustrate the appearance of the grille portion of the front face of the door panel 106 of the loudspeaker 100, as viewed from outside, as the rotation of the second grille 104 proceeds behind the static first grille 102, according to one or more embodiments.

Figure 2A:
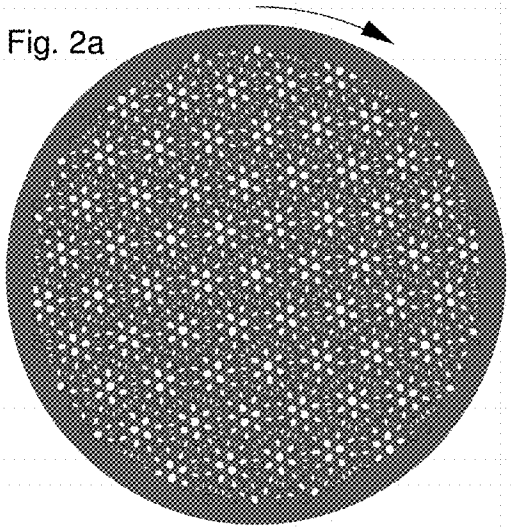
FIGS. 2*a* to 2*f* show, in sequence, an illustration of components of a loudspeaker system viewed from the front, in accordance with one or more embodiments.
Figure 2B:
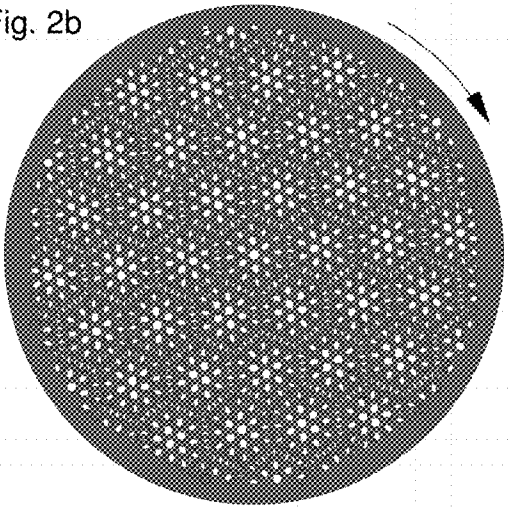
Figure 2C:
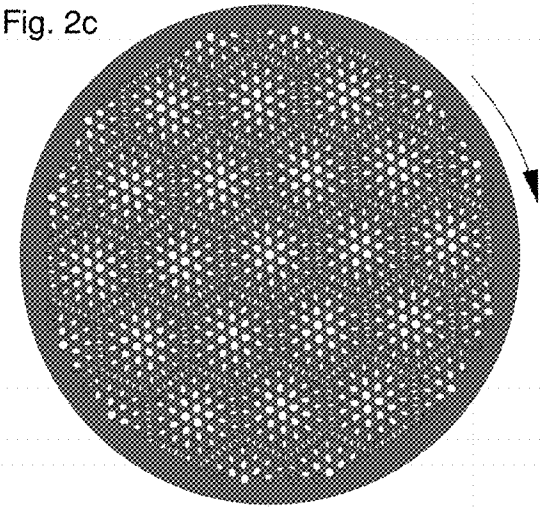
Figure 2D:
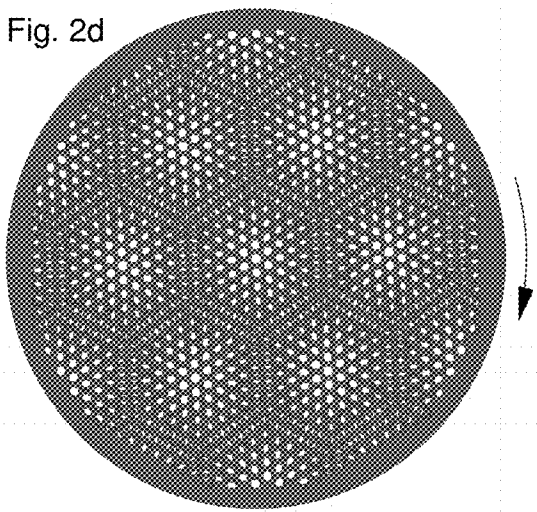
Figure 2E:
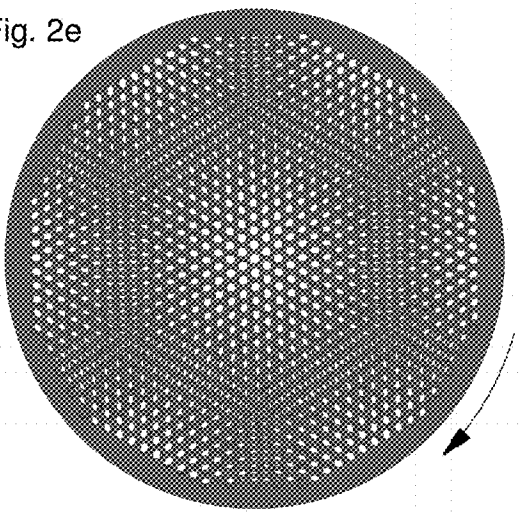

FIG. 2*a* shows a "starting position", when the perforations in the first grille 102 and the second grille 104 are not perfectly aligned. In other words, in this position, the solid portions of the second grille 104 are partially obscured by the solid portions of the first grille 102. However, by virtue of the first grille 102 and the second grille 104 being aligned at their respective centres and having the same overall arrangement of perforations, a certain overall geometric pattern results from the "non-alignment" of the holes.

As the second grille 104 gradually rotates, for example in a clockwise direction, at a small distance behind the first grille 102, the solid portions of the second grille visible through each perforation of the first grille come and go. In one aspect, where the holes are circular and hexagonally packed, the combined geometric effect is the apparent emergence of more complex evolving patterns.

As seen in FIGS. 2*b*, 2*c*, 2*d* and 2*e*, as the clockwise rotation of the second grille 104 proceeds, the exact manner and extent of its obstruction by the first grille 102 continue to vary, the ever-changing superposition resulting in the perceived emergence of evolving hexagons, which appear to change in size and number across the entirety of the circular grille. This visual phenomenon is a type of Moiré effect.

Figure 2F:
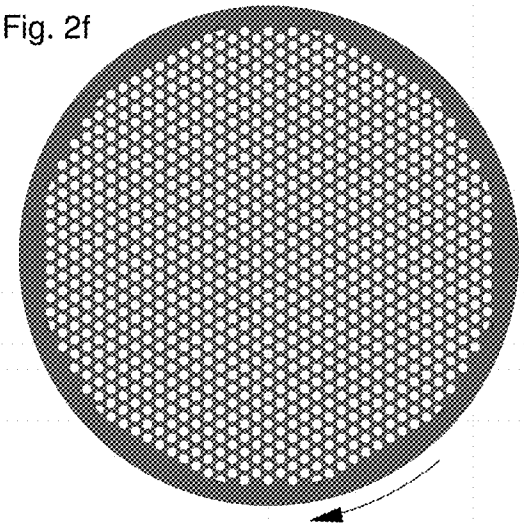
Figure 3A:
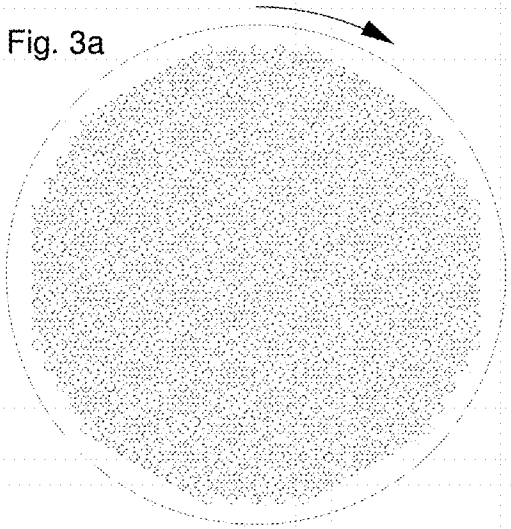
FIGS. 3*a* to 3*f* are clear line drawing versions of FIGS. 2*a* to 2*f*, respectively.
Figure 3B:
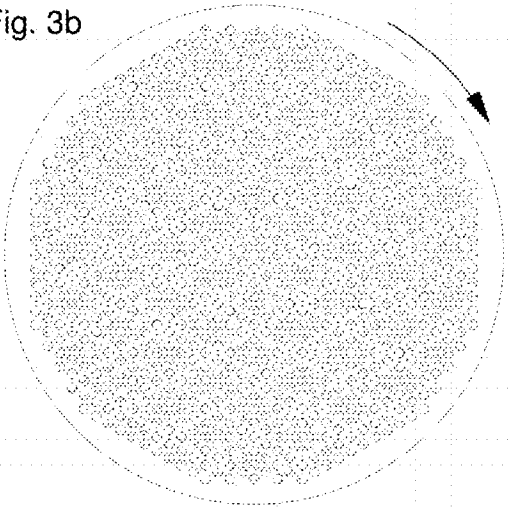
Figure 3C:
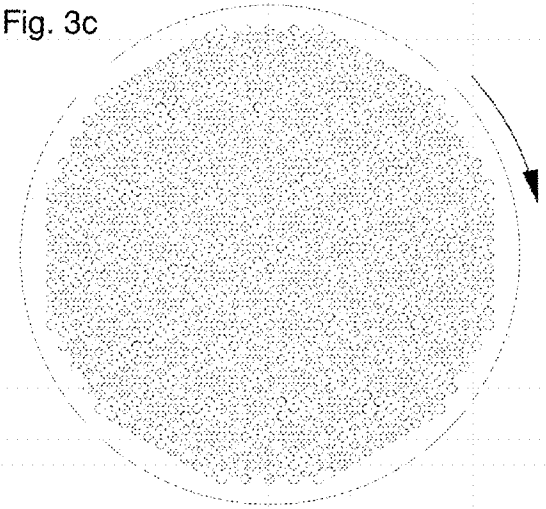
Figure 3D:
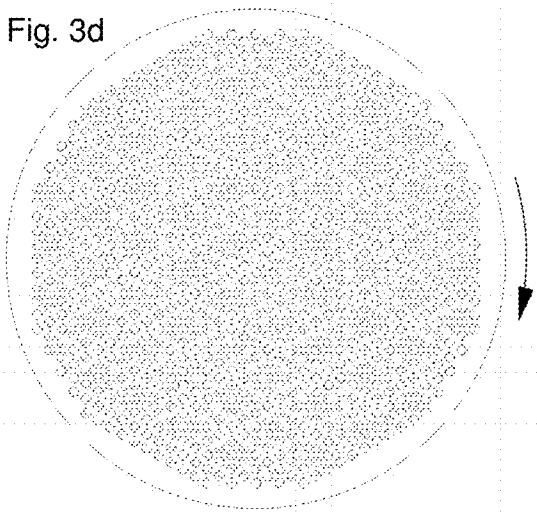
Figure 3E:
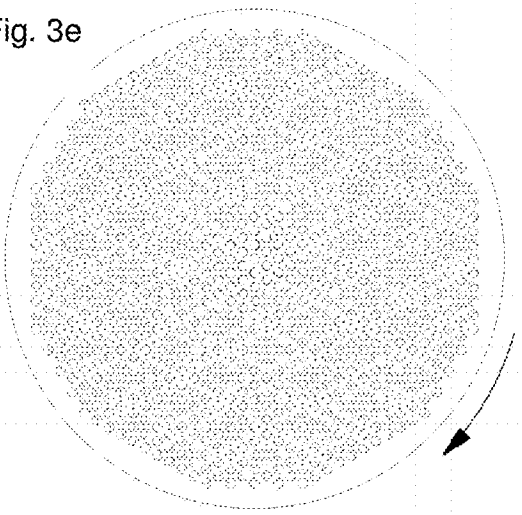
Figure 3F:
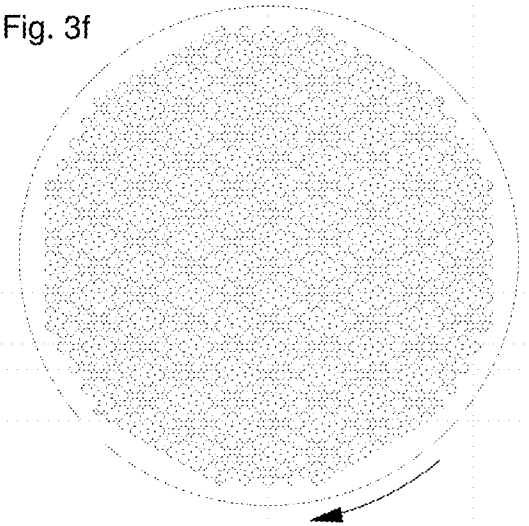

The second grille 104 can be rotated until the second grille 104 reaches a "final position", in which it is totally aligned with the first grille 102, that is, each of the perforations on the first grille 102 aligns, perfectly or substantially, with a corresponding perforation on the second grille, as in FIG. 2*f*.

The above sequence, with the relative rotational position of the two grilles progressing from the so-called non-alignment of FIG. 2*a*, through FIGS. 2*b* to 2*e*, up to the total alignment of FIG. 2*f*, can be described as an "opening operation" of the first grille 102 and the second grille 104. The reverse, a "closing operation", can be performed as the second grille 104 is made to rotate in the opposite direction, i.e., the anti-clockwise direction, progressing from the complete alignment of perforations shown in FIG. 2*f*, through FIGS. 2*e* to 2*b*, ending in the "starting position" of FIG. 2*a*.

FIGS. 3*a* to 3*f* are the same as FIGS. 2*a* to 2*f*, respectively, but in the form of clear line drawings.

The above-described arrangement of a set of grilles for loudspeaker equipment may be used, for example, in an automotive vehicle integrated with a hi-fi audio system. For example, the door panel 106 may form a portion of an automotive interior surface or part.

The presently disclosed arrangement creates an engaging, dynamic visual effect resulting in a whole new user experience for owners of a privately-owned vehicle and customers of a luxury rental car, for example, whereas normal loudspeaker grilles feel static and uninteresting. However, the arrangement is not merely aesthetically pleasing to look at; new technical effects are also achieved that are advantageous over prior grille arrangements.

As an example, when a car sound system is off, the first grille 102 and the second grille 104 are disposed in the starting position corresponding to FIG. 2*a* where the first grille 102 and the second grille 104 are not aligned. When the sound system is turned on (such as when the car engine is started), the second grille 104 gradually moves, and stops when the final position is reached, corresponding to FIG. 2*f* where the second grille 104 aligns with the first grille 102. At the final position, acoustic transparency is optimal; on the other hand, acoustic transmission is sub-optimal at the starting position, and any sound waves coming from the transducer may be lower in volume or muffled in quality, or may differ from sound waves emitted when the first grille 102 and the second grille 104 are aligned at the final position. In the process of movement (FIGS. 2*b* to 2*e*), acoustic transparency or the sound quality in general may change in a gradual manner, for example, from a duller, deeper timbre to a higher-volume, brighter texture. This provides a simple, mechanical way to create an engaging, dynamic sound effect to the listener (for example, a gradual brightening of music as his or her journey in the vehicle begins, and a gradual blurring of music as the journey comes to an end), without the need for further digital programming or other filters, for example.

The present arrangement is also technically advantageous in that any user of can be clearly and immediately informed whether the sound system is turned on or off, just by having a quick look at the front face of the loudspeaker 100, rather than, for example, looking at a small light indicating the on/off state, as is standard in many stereo systems in automobiles, homes or offices. This is achieved by the highly visible transformation in the perceived perforation pattern in the loudspeaker, caused by the motorised movement of at least one of the first grille 102 and the second grille 104.

Methods of operating a loudspeaker 100, in particular of controlling one or more grilles in a loudspeaker system, are also herein disclosed.

Figure 4:
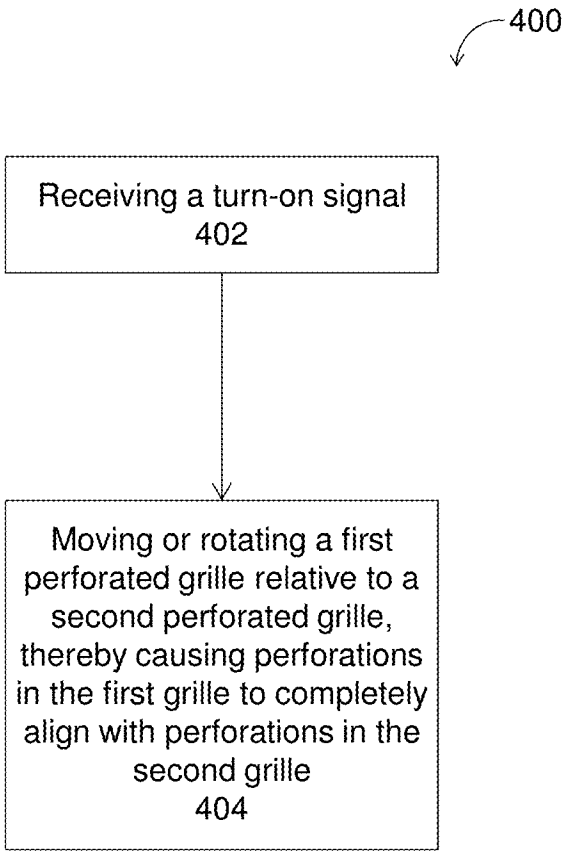
FIG. 4 is a flow chart illustrating an exemplary method of operating a loudspeaker according to one or more embodiments.

According to an exemplary embodiment, a method 400 is carried out at a loudspeaker that comprises at least first and second perforated grilles, with reference to flow diagram FIG. 4. These grills may be disposed adjacent and parallel to each other. In step 402, a first signal, such as a turn-on signal, is received by the loudspeaker. In step 404, the first grille is moved or rotated relative to the second grille to a different position or orientation, thereby causing perforations in the first grille to fall into a first alignment with perforations in the second grille; for example, the perforations in the first grille is made to completely align with those in the second grille.

Figure 5:
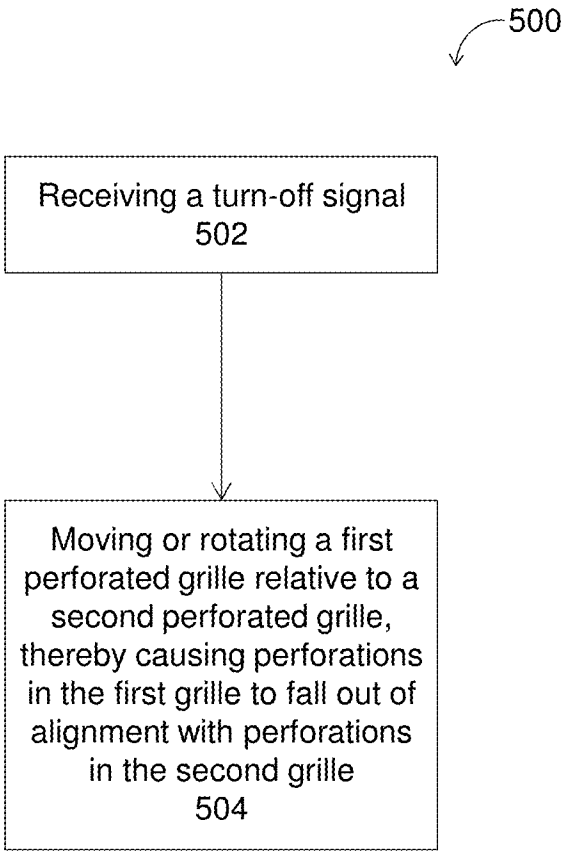
FIG. 5 is a flow chart illustrating an exemplary method of operating a loudspeaker according to one or more embodiments.

According to an exemplary embodiment, a method 500 is carried out at a loudspeaker that comprises at least first and second perforated grilles, with reference to flow diagram FIG. 5. In step 502, a second signal, such as a turn-off signal, is received by the loudspeaker. In step 504, the first grille is moved or rotated relative to the second grille to a different position or orientation, thereby causing perforations in the first grille to reach a second alignment with perforations in the second grille; for example, the perforations in the first grille is caused to fall out of alignment with those in the second grille.

In some embodiments and aspects, a loudspeaker comprising the presently disclosed arrangement of dynamic grilles is at least powered by an electrical signal for the movement of the grilles, and a separate electrical acoustic signal. In some other embodiments and aspects, the motion of the grilles and the acoustic functions of the loudspeaker are powered by the same signal(s).

Modifications and variations to the embodiments described above are possible where appropriate. Several exemplary alternative embodiments and aspects are described below.

In some embodiments and aspects, one or both of the first grille and the second grille are movable by means of one or more motors in the loudspeaker system, as long as a relative motion between the first and second grilles is created.

In some embodiments and aspects, the relative movement between the first grille 102 and the second grille 104 is created not by rotating one of the first grille 102 and the second grille 104, but using alternative types of movement. For example, the relative movement may involve a translational movement such as a lateral displacement, or a rotation or tilting relative to an axis that may or may not pass through a grille, or a combination thereof. For example, one of the first grille 102 and the second grille 104 is rotated and the other one is laterally displaced. As another example, both the first grille 102 and the second grille 104 are circular but are disposed non-concentrically or non-coaxially, and are rotated between respective first and second orientations. As another example, one of the first grille 102 and the second grille 104 is fixed and the other one is laterally displaced and rotated at the same time to move, in a rolling motion, to a concentrically aligned position from a "misaligned" position.

In some other aspects, a grille may not be planar, but a curved section of a cylinder or sphere, for example. For example, the grilles are each in the form of a curved section of a cylindrical surface, and one or both of the grilles are rotated relative to the other about the central axis of the cylinder.

In some aspects, the grilles are not always disposed to be parallel to each other, or to follow substantially the same curved geometry. For example, one of the grilles may be aligned to a predefined axis, and the other grille may be offset or angled (e.g. by up to 5 degrees) with respect to the axis, in at least one position such as a starting position. For example, a grille may be tilted (e.g. rotated with respect to an axis that is coplanar with the grille) from a starting position to reach a final position in which the grilles are parallel.

In some aspects, the perforations in the grilles may not be circular, or of uniform shape and size, to cater to different considerations, acoustic or otherwise.

In some embodiments and aspects, the arrangement of the perforations in the first grille is different from that in the second grille. For example, the perforations in the innermost of the two grilles may form a specific pattern that is only clear visible when the second grille is in a certain position relative to the first grille, but totally or partially obscured when the second grille is in other positions. For example, the outline of a logo may be formed from the collective shape of the perforations of the inner grille and be visible through the outer grille in a starting position, but may gradually appear to dissolve as the inner grille is moved and obscured by the outer grille, until it is rendered completely invisible as the sound system (or a vehicle containing the system) is fully started up, or vice versa.

In some other embodiments and aspects, the geometric arrangement of the perforations in the first grille is the same as that in the second grille, but the second grille is made distinct from the first grille by including an additional visual aspect in its solid portions, to extend or heighten a visual impact. For example, a logo of the vehicle hire company or a text (such as a welcome greeting) may be formed on a face of the inner grille by coating, etching or engraving.

Figure 6B:
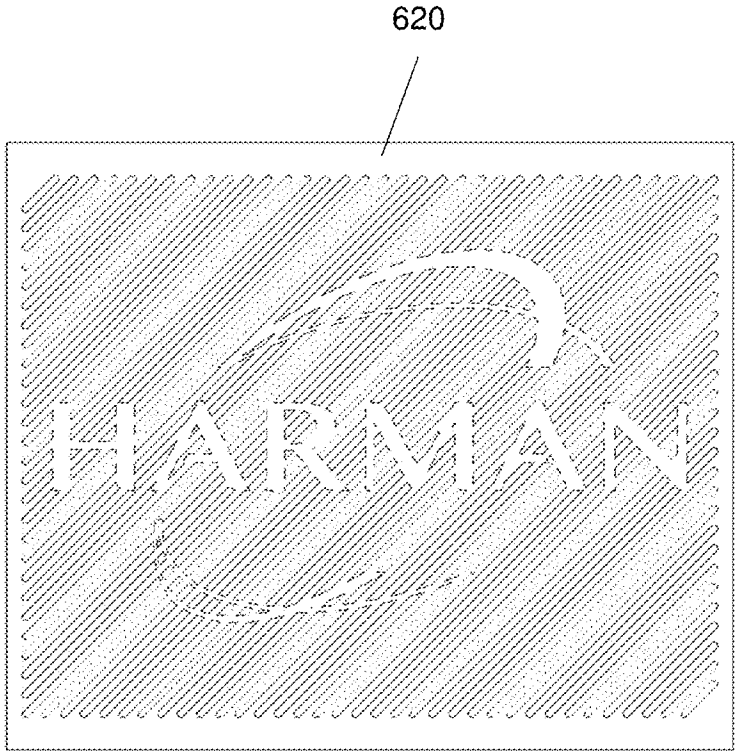
FIGS. 6*a* and 6*b* illustrate components in a loudspeaker system according to one or more embodiments.
Figure 6A:
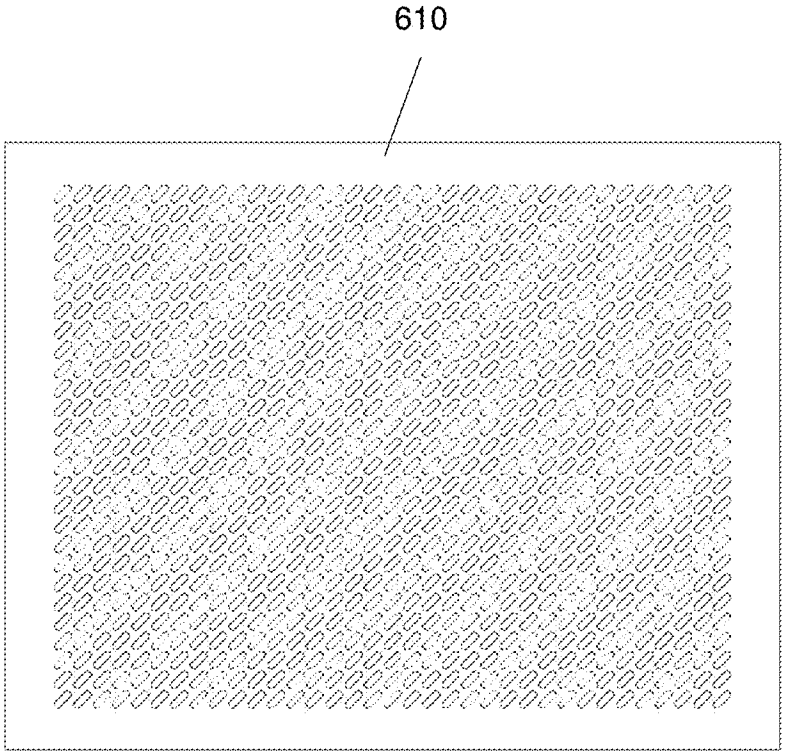
Figure 7:
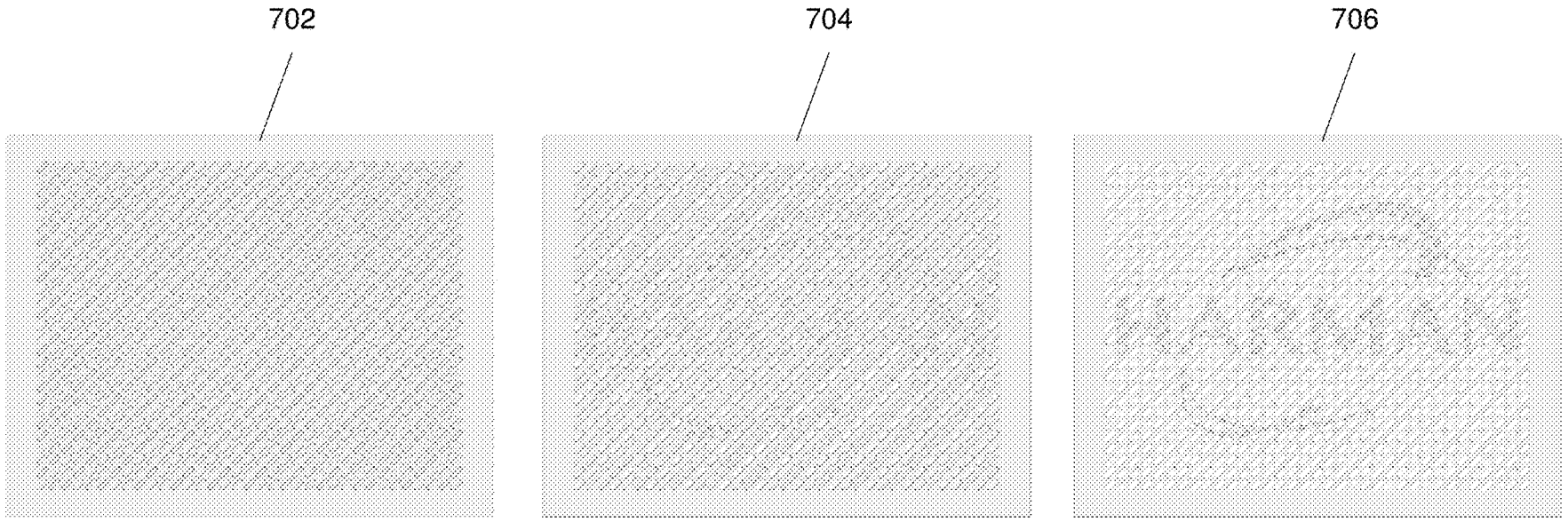
FIG. 7 illustrates components in a loudspeaker system according to one or more embodiments.

An example incorporating some of the above aspects and variations is illustrated with reference to FIGS. 6*a*, 6*b* and 7. A first grille 610 comprises a regular arrangement of perforations, in the form of holes that are slightly elongated at an angle. A second grille 620, located behind the first grille 610, comprises perforations in the form of long slits at the same angle, with modifications to some of the perforations to incorporate a specific pattern across a large area of the second grille. The grilles are operable to move relative to each other, from a starting position 702, through intermediate positions such as position 704, towards a final position 706. In this example, in the starting position 702, the perforations in the second grille are obscured by the first grille, as the two sets of perforations do not align; during movement 704 between the starting and final positions, the specific pattern or aspects thereof emerge gradually through the perforations of the first grille as the relative alignment of the grilles changes, until the final position 706 is reached, when the specific pattern or aspects thereof are clearly visible to the observer.

In some aspects, the perforations in the two grilles are arranged such that there is at least one relative position, such as a starting or "closed" position, in which there are no or few gaps or openings in the front face between the interior and exterior of the loudspeaker (i.e. all or most of the perforations in one grille align with a solid portion of the other grille), effectively sealing off the interior where acoustic, electrical and other components are located; this helps to avoid dust from entering when the speaker is in this position, such as when it is turned off.

The description of embodiments and aspects has been presented merely for purposes of illustration and description. Suitable modifications and variations to these embodiments and aspects may be performed in light of the above, and different embodiments and aspects may be combined where possible and appropriate, without departing from the scope of protection as determined by the claims.

What is claimed is:

1. A loudspeaker for a car sound system, comprising:

a first grille including a first arrangement of perforations;

a second grille including a second arrangement of perforations; and a motor operable to move or rotate the second grille;

wherein the second grille is operable to move relative to the first grille from a start position to a final position, and wherein the second grille is disposed in the start position when the car sound system is off, wherein the second grille is arranged to move to and stop in the final position when the car sound system is turned on, wherein, when the second grille is in the final position, perforations in the second grille and perforations in the first grille completely align, and wherein, when the second grille is in the start position, perforations in the second grille and perforations in the first grille do not completely align.

2. The loudspeaker of claim 1, wherein the first arrangement of perforations is the same as the second arrangement of perforations.

3. The loudspeaker of claim 1, wherein the first grille is disposed on a first plane and the second grille is disposed on a second plane parallel to the first plane, and the first plane and the second plane are separated by a small gap close to zero.

4. The loudspeaker of claim 1, wherein the first grille and the second grille are substantially circular, and the second grille is operable to rotate about a center thereof.

5. The loudspeaker of claim 1, wherein the first grille is fixed.

6. The loudspeaker of claim 1, wherein the second grille rotates from a first position to a second position when the loudspeaker receives a first signal, and the second grille rotates from the second position to the first position when the loudspeaker receives a second signal.

7. The loudspeaker of claim 1, wherein a relative rotation between the second grille and the first grille creates a dynamic Moiré effect.

8. The loudspeaker of claim 1, wherein a front-facing face of the second grille has a distinct appearance from a front-facing face of the first grille.

9. The loudspeaker of claim 1, wherein the first grille is an outer grille of the loudspeaker and the second grille is an inner grille of the loudspeaker.

10. The loudspeaker of claim 1, wherein the loudspeaker is integrated into an automotive vehicle.

11. A method of operating a loudspeaker for a car sound system, the loudspeaker comprising a first perforated grille and a second perforated grille that are moveable relative to one another, wherein the second grille is disposed in a start position when the sound system is off, the method comprising:

when the sound system is turned on, moving the second perforated grille relative to the first perforated grille from the start position to a final position and stopping the second perforated grille in the final position when the final position is reached, wherein, when the second grille is in the final position, perforations in the second grille and perforations in the first grille completely align, and wherein, when the second grille is in the start position, perforations in the second grille and perforations in the first grille do not completely align.

* * * * *